US006274092B1

(12) United States Patent
Itoh

(10) Patent No.: US 6,274,092 B1
(45) Date of Patent: Aug. 14, 2001

(54) TEST TUBE HOLDER

(76) Inventor: Teruaki Itoh, 5-25 Kokaihommachi, Kumamoto-shi, Kumamoto-ken (JP)

( * ) Notice: Subject to any disclaimer, the term of this patent is extended or adjusted under 35 U.S.C. 154(b) by 0 days.

(21) Appl. No.: 09/352,652

(22) Filed: Jun. 30, 1999

(30) Foreign Application Priority Data

Mar. 5, 1999 (JP) ..... 11-058894

(51) Int. Cl.[7] ..... B01L 9/00

(52) U.S. Cl. ..... 422/104; 422/63; 422/65; 422/66; 422/99; 422/102; 436/47; 206/443; 211/60.1; 211/74

(58) Field of Search ..... 422/99, 102, 104, 422/63, 65, 66; 436/43, 47; 206/199, 201, 443; 211/60.1, 74, 77

(56) References Cited

U.S. PATENT DOCUMENTS

| | | | | |
|---|---|---|---|---|
| 5,137,693 | * | 8/1992 | Mawhirt | 422/104 |
| 5,378,433 | * | 1/1995 | Duckett et al. | 422/100 |
| 5,651,941 | * | 7/1997 | Stark et al. | 422/104 |
| 5,687,849 | * | 11/1997 | Borenstein et al. | 206/446 |
| 5,777,303 | * | 7/1998 | Berney | 235/375 |
| 5,941,366 | * | 8/1999 | Quinlan et al. | 198/465.1 |
| 5,985,219 | * | 11/1999 | Lind | 422/104 |
| 5,993,745 | * | 11/1999 | Laska | 422/104 |
| 6,065,617 | * | 5/2000 | Cohen et al. | 211/74 |
| 6,081,326 | * | 6/2000 | Rousseau et al. | 356/246 |
| 6,123,205 | * | 9/2000 | Dumitrescu et al. | 211/74 |

FOREIGN PATENT DOCUMENTS

| | | |
|---|---|---|
| 4868598 | 9/1973 | (JP) . |
| 5272785 | 6/1977 | (JP) . |
| 52137893 | 11/1977 | (JP) . |
| 317566 | 2/1991 | (JP) . |
| 915246 | 1/1997 | (JP) . |

* cited by examiner

*Primary Examiner*—Jill Warden
*Assistant Examiner*—Dwayne K Handy
(74) *Attorney, Agent, or Firm*—Volpe and Koenig, P.C.

(57) ABSTRACT

A test tube holder according to the present invention includes a holder body having a cylindrical body having a cylindrical hollow formed to a given depth from the top to the bottom along the axis of the holder body and designed to hold a test tube, a tightening ring mounting small-diameter section formed on the outer surface and near the top of the cylindrical body, and an engagement section formed on the outer surface and near the bottom of the cylindrical body and engaged with a guide rail for conveyance. The test tube holder also includes a plurality of slits cut in the cylindrical body to a given depth from the top to the bottom in parallel with the axis of the holder body, a plurality of flat springs one end of each of which is inserted into and supported by a corresponding one of the plurality of slits and the other end of each of which is provided with a displacement force so as to approach the axis of the cylindrical body, and a tightening ring fitted on an outer surface of the small-diameter section of the cylindrical body so as to compress and hold the one end of each of the plurality of flat springs by narrowing a space between the slits into which the flat springs are inserted.

3 Claims, 3 Drawing Sheets

TEST TUBE HOLDER

BACKGROUND OF THE INVENTION

The present invention relates to a test tube holder for use in carrying a test tube in which a specimen such as blood is put from point A to point B in order to sample or dispense the specimen.

Conventionally a so-called cylindrical rack has been used a lot as the above test tube holder. The cylindrical rack has a hollow for receiving and holding a test tube along the axis of a columnar substrate made of synthetic resin.

A ring-shaped engagement groove is formed on the outer surface of the cylindrical rack. When the rack is conveyed by a conveyor belt, the groove is engaged with guide rails of the conveyor belt.

The above conventional conveyor cylindrical rack or the test tube holder is so designed that the size of the hollow conforms to that of a specific test tube. For this reason, the conventional holder cannot be applied to test tubes whose sizes (especially outside diameters) are different from that of the specific test tube.

BRIEF SUMMARY OF THE INVENTION

The object of the present invention is to provide a general-purpose test tube holder which is applicable to a plurality of test tubes having different outside diameters.

To attain the above object, the test tube holder according to the present invention has the following features in constitution. The other features will be clarified in the Description of the Invention.

A test tube holder comprising:

a holder body including:

a cylindrical body having a cylindrical hollow formed to a given depth from a top to a bottom along an axis of the holder body and designed to hold a test tube, a tightening ring mounting small-diameter section formed on an outer surface and near the top of the cylindrical body, and an engagement section formed on the outer surface and near the bottom of the cylindrical body and engaged with a guide rail for conveyance;

a plurality of slits cut in the cylindrical body to a given depth from the top toward the bottom in parallel with the axis of the holder body;

a plurality of flat springs one end of each of which is inserted into and supported by a corresponding one of the plurality of slits and the other end of each of which is provided with a displacement force so as to approach the axis of the holder body; and a tightening ring fitted on an outer surface of the small-diameter section of the cylindrical body so as to compress and hold the one end of each of the plurality of flat springs by narrowing a space between the slits into which the flat springs are inserted.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiments given below, serve to explain the principles of the invention.

DETAILED DESCRIPTION OF THE INVENTION (Embodiment)

Figure 1:
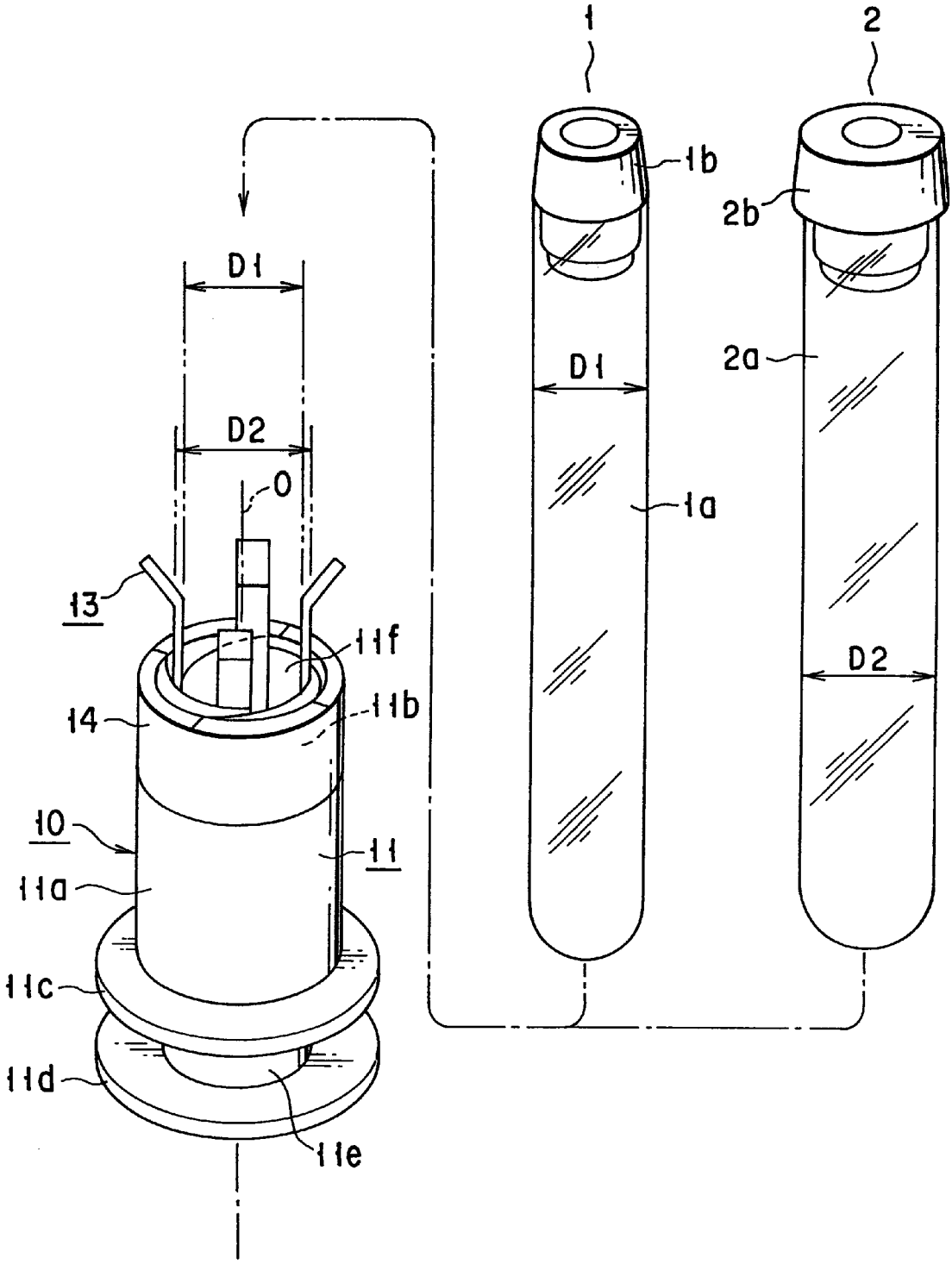
FIG. 1 is a perspective view schematically showing the constitution of a test tube holder according to an embodiment of the present invention.

As illustrated in FIG. 1, a test tube holder 10 according to an embodiment of the present invention includes a holder body 11 made of synthetic resin, a spring mechanism 13 for holding a test tube, and a tightening ring 14 as main components.

The holder body 11 is formed like a cylinder as a whole. More specifically, the holder body 11 includes a cylindrical body including a cylindrical hollow 11*f* (for holding, e.g., test tubes 1 or 2) which is formed to a given depth along the axis O from the top (upper in FIG. 1) to the bottom (lower in FIG. 1) of the holder body.

The cylindrical body includes a large-diameter section 11*a* in its middle along its longitudinal direction and a small-diameter section 11*b* at the top end thereof. The large-diameter section 11*a* has a relatively large outside diameter which is somewhat larger than that of the small-diameter section 11*b*. The tightening ring 14, which will be described later, is mounted on the outer surface of the small-diameter section 11*b*. A pair of flange sections 11*c* and 11*d* is provided on the outer surface of the cylindrical body in close proximity to the bottom thereof to serve as an engaging portion which can be engaged with guide rails (not shown) for conveyance. The flange sections are arranged at regular intervals along the axis O of the cylindrical body. A ring-shaped groove 11*e* is formed between the paired flange sections 11*c* and 11*d*. The spring mechanism 13 is mounted in the hollow 11*f* of the cylindrical body.

As will be described later, the spring mechanism 13 is constituted of a plurality of flat springs and capable of stably holding each of the test tubes 1 and 2 having different outside diameters D1 and D2 when it is inserted into the holder. As shown, the openings of tube bodies 1*a* and 2*a* of the test tubes 1 and 2 can be closed with caps 1*b* and 2*b*, respectively.

Figure 2:
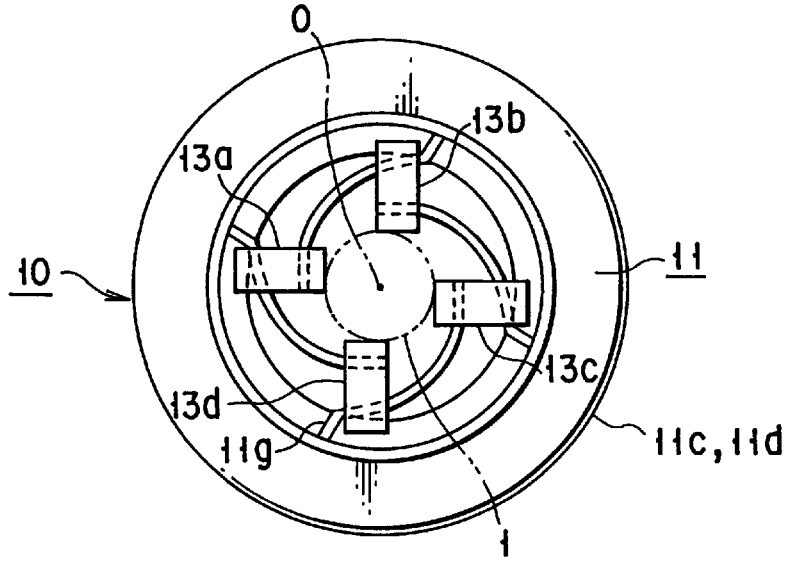
FIG. 2 is a top view specifically showing the constitution of the test tube holder according to the embodiment of the present invention.
Figure 3:
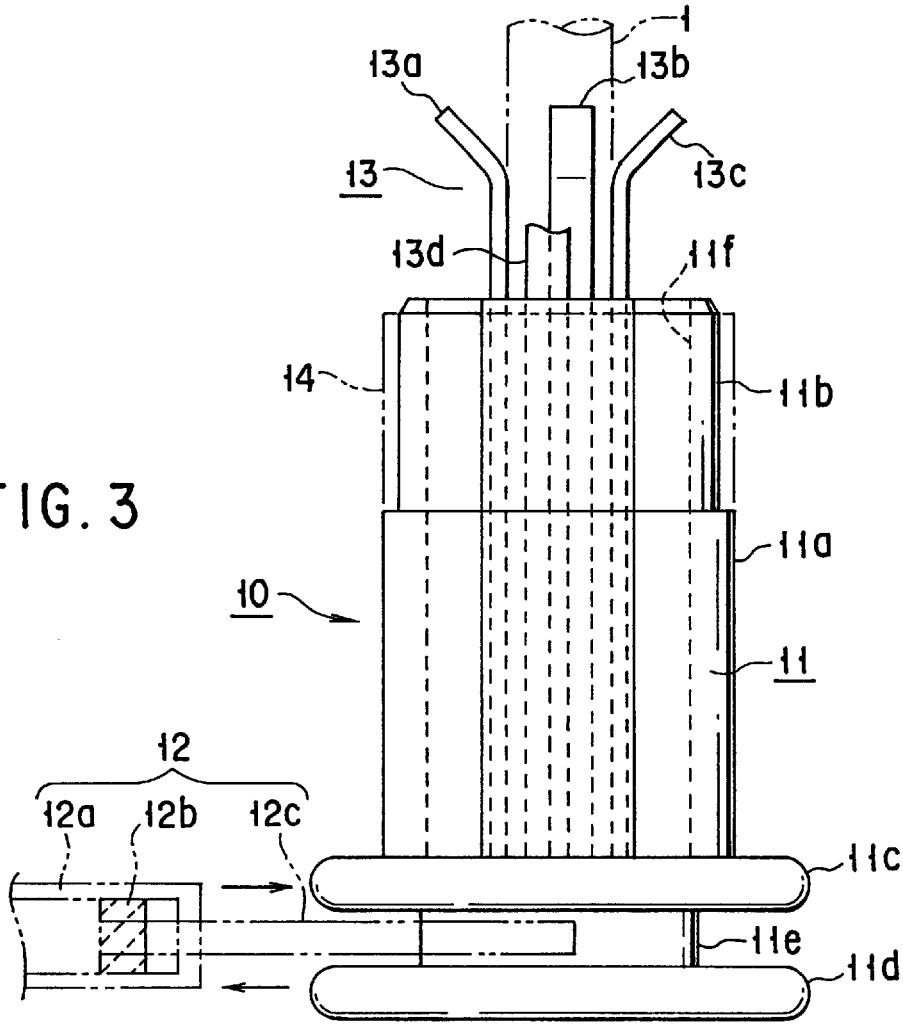
FIG. 3 is a side view specifically showing the constitution of the test tube holder according to the embodiment of the present invention.

FIGS. 2 and 3 are top and side views specifically showing the constitution of the test tube holder according to the embodiment of the present invention. As described above, the paired flange sections 11*c* and 11*d* can be engaged with the guide rails, e.g., the guide rails arranged on both sides of a conveyor belt (not shown). These flange sections are used to prevent the holder body 11 from falling down due to a vibration during the conveyance of the holder body 11 by the conveyor belt.

The ring-shaped groove 11*e* formed between the flange sections 11*c* and 11*d* is a stop operation groove for stopping the holder body 11 in a specific position of the conveyor belt by a piston/cylinder device 12 for controlling the conveyance of the holder body 11.

The piston/cylinder device 12 is mounted in a given position of the guide rails. This device 12 includes a cylinder 12*a,* a piston 12*b* slidably controlled by compressed air supplied into the cylinder 12*a,* and an operation pin 12*c* coupled to the piston 12*b*.

To intermit the conveyance of the holder body 11, the piston/cylinder device 12 is actuated. Then, the operation pin 12*c* approaches a conveyance path of the conveyor belt from a direction perpendicular to the carrying path. Thus, the operation pin 12*c* is inserted in the ring-shaped groove 11*e* of the holder body 11 to stop the conveyance of the holder body 11. Consequently, the holder body 11 can be slipped and stopped temporarily in a specific position without stopping the conveyor belt.

To resume the conveyance of the holder body 11 by the conveyor belt, the piston/cylinder device 12 has only to be actuated reversely to pull the operation pin 12*c* out of the conveyance path.

The test tube holding spring mechanism 13 is constituted of a plurality of flat springs 13*a* to 13*d* of elastic materials such as phosphor bronze and stainless steel (the number of flat springs is four in this embodiment). One edge of each of the flat springs 13*a* to 13*d* is inserted into and supported by its corresponding one of slits 11*g* formed in the circumferential wall of the cylindrical body of the holder body 11.

The slits 11*g* are cut to a given depth (e.g., a depth corresponding to the length of the small-diameter section 11*b*) from the top to the bottom of the cylindrical body 11 in parallel with the axis of the cylindrical body 11.

The other edges of the flat springs 13*a* to 13*d* are provided with a displacement force so as to approach the axis O of the holder body 11. Thus, the outer surface of the test tube 1 inserted into the test tube holder 10 is supported and held by the four edges of the flat springs 13*a* to 13*d,* as indicated by the two-dot-one-dash line.

The tightening ring 14, which is made of metal such as stainless steel, is fitted on the outer surface of the small-diameter section 11*b* of the holder body 11 by, e.g., a fitting means. Thus, a space between the slits 11*g* is narrowed, and the one edge of each of the flat springs 13*a* to 13*d* is firmly compressed and held in its corresponding slit 11*g*.

Figure 4:
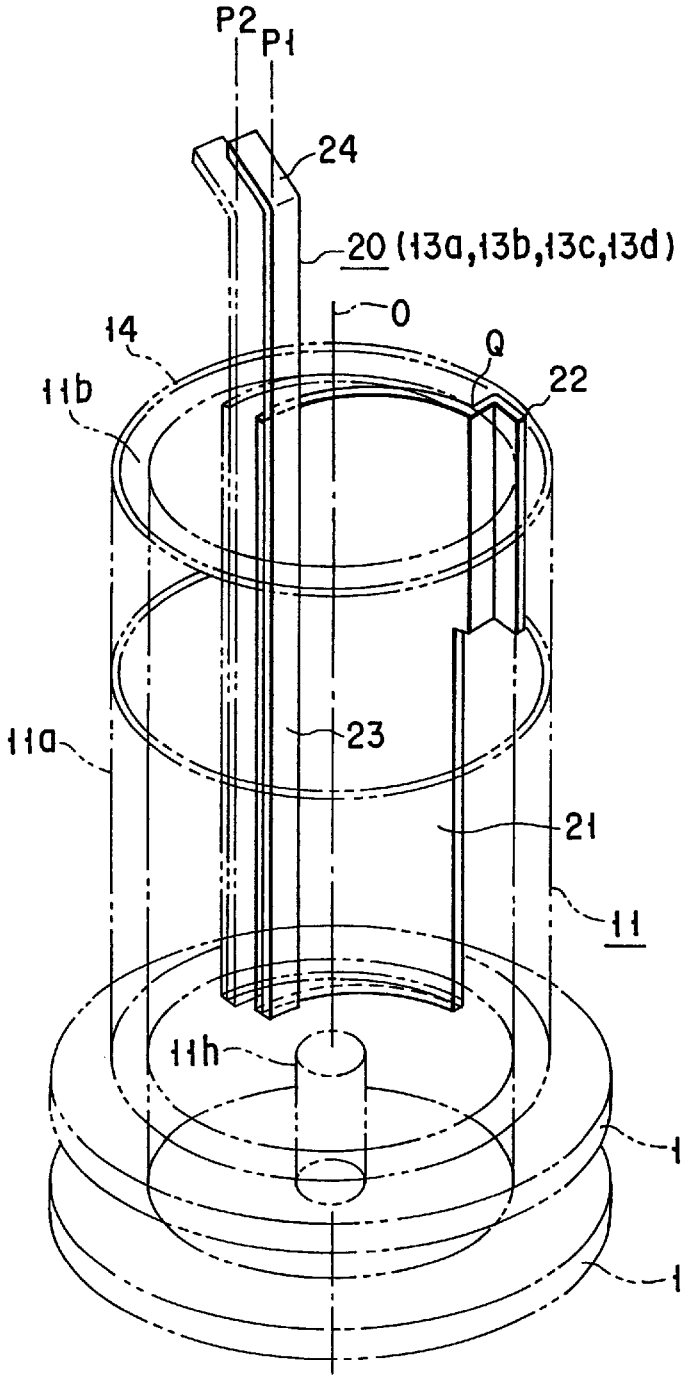
FIG. 4 is a perspective view specifically showing the constitution of one flat spring of the test tube holder according to the embodiment of the present invention.
Figure 5:
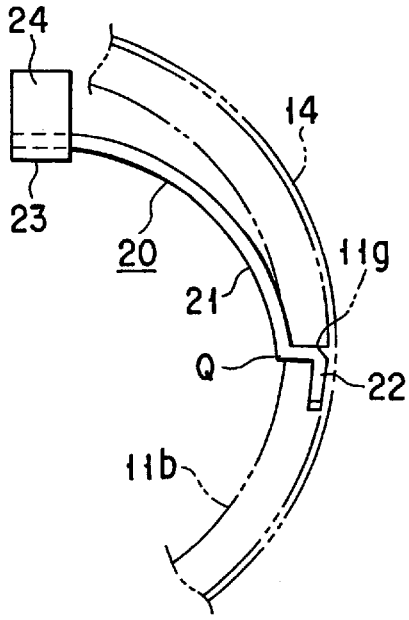
FIG. 5 is a top view specifically showing the constitution of the one flat spring of the test tube holder according to the embodiment of the present invention.

FIGS. 4 and 5 are perspective and top views specifically showing the constitution of one 20 of the flat springs 13*a* to 13*d*. As illustrated in FIGS. 4 and 5, the flat spring 20 includes an elongated flat spring body 21 which is curved like an arc by the curvature approximate to that of the inner surface of the holder body 11, a support member 22 formed on at least part of one side edge of the flat spring body 21 and inserted into the slit 11*g,* a bar-shaped contact section 23 formed on the other side edge of the flat spring body 21 and contacting the outer surface of each of the test tubes 1 and 2 at a given pressure in its longitudinal direction, and a test tube inserting guide section 24 connected to the top of the contact section 23 and having an inclined plane which is inclined gradually in a direction away from the axis of the holder body 11.

In the embodiment shown in FIGS. 4 and 5, the support member 22 has an L-shaped, hooked end portion, and the shape of the slit 11*g* conforms to that of the end portion of the support member 22. Therefore, the function of compressing and holding the flat spring 20 in the slit 11*g* is improved to a great extent.

With the above constitution, when the test tube 1 having the outside diameter D1 is inserted into the test tube holder 10, the contact section 23 of the flat spring 20 contacts the outer surface of the test tube 1 in position P1. When the test tube 2 having the outside diameter D2 is inserted thereinto, the flat spring 20 is bent toward a larger diameter of the holder 10 with regard to the position of symbol Q as an axis, as indicated by the two-dot-one-dash line, and the contact section 23 thereof contacts the outer surface of the test tube 2 in position P2.

In the embodiment shown in FIGS. 4 and 5, the contact section 23 is formed separately from the flat spring body 21 and then bonded thereto. However, the contact section 23 can be formed from the flat spring body 21 by folding the other end of the body 21.

In other words, the flat spring body 21, support member 22, contact section 23 and test tube inserting guide section 24 can be formed integrally as one component by processing a single elastic member. In this case, the holder can easily be manufactured and decreased in manufacturing costs.

In FIG. 4, reference numeral 11*h* denotes a through hole formed in the bottom portion of the holder body 11.

(Modifications)

The test tube holder according to the foregoing embodiment can be modified as follows:

1) The support member 22 is formed throughout the entire length of the elongated flat spring body 21.

2) The flat springs 13*a* to 13*d* are constituted of elastic members of, e.g., synthetic resin other than metal.

3) In place of the flange sections 11*c* and 11*d,* a pair of ring-shaped grooves is formed as an engagement section.

(Features of the Embodiment)

[1] A test tube holder (10) according to the embodiment comprises:

a holder body (11) including:

a cylindrical body (11*a,* 11*b*) having a cylindrical hollow (11*f*) formed to a given depth from the top to the bottom along the axis (O) of the holder body and designed to hold a test tube (1, 2), a tightening ring mounting small-diameter section (11*b*) formed on the outer surface and near the top of the cylindrical body (11*a,* 11*b*), and an engagement section (11*c,* 11*d*) formed on the outer surface and near the bottom of the cylindrical body (11*a,* 11*b*) and engaged with a guide rail for conveyance;

a plurality of slits (11*g*) cut in the cylindrical body (11*a,* 11*b*) to a given depth from the top to the bottom in parallel with the axis (O) of the holder body (11);

a plurality of flat springs (13*a,* 13*b,* 13*c,* 13*d*) one end of each of which is inserted into and supported by a corresponding one of the plurality of slits (11*g*) and the other end of each of which is provided with a displacement force so as to approach the axis (O) of the holder body (11); and a tightening ring (14) fitted on an outer surface of the small-diameter section (11*b*) of the cylindrical body (11*a,* 11*b*) so as to compress and hold the one end of each of the plurality of flat springs (13*a,* 13*b,* 13*c,* 13*d*) by narrowing a space between the slits (11*g*) into which the flat springs (13*a,* 13*b,* 13*c,* 13*d*) are inserted.

[2] The test tube holder according to the above item [1], wherein each (20) of the plurality of flat springs (13*a,* 13*b,* 13*c,* 13*d*) includes:

an elongated flat spring body (21) curved like an arc by a curvature approximate to that of an inner surface of the holder body (11);

a support member (22) formed on at least part of one side edge of the flat spring body (21) and inserted into and supported by a corresponding one of the slits (11*g*);

a bar-shaped contact section (23) formed on the other side edge of the flat spring body (21) and contacting an outer surface of the test tube (1, 2) at a given pressure in a longitudinal direction thereof; and a test tube inserting guide section (24) connected to an end portion of the contact section (23) and having an inclined plane which is inclined gradually in a direction away from the axis (O) of the holder body (11).

[3] The test tube holder according to the above item [2], wherein the flat spring body (21), support member (22), contact section (23) and test tube inserting guide section (24) are formed integrally as one component by processing a single elastic member.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A test tube holder comprising:

a holder body including:

a cylindrical body having a cylindrical hollow formed to a given depth from a top to a bottom along an axis of the holder body and designed to hold a test tube, a tightening ring mounting small-diameter section formed on an outer surface and near the top of the cylindrical body, and an engagement section formed on the outer surface and near the bottom of the cylindrical body and engaged with a guide rail for conveyance;

a plurality of slits cut in the cylindrical body to a given depth from the top to the bottom in parallel with the axis of the holder body;

a plurality of flat springs one end of each of which is inserted into and supported by a corresponding one of the plurality of slits and another end of each of which is provided with a displacement force so as to approach the axis of the holder body; and a tightening ring fitted on an outer surface of the small-diameter section of the cylindrical body so as to compress and hold the one end of each of the plurality of flat springs by narrowing a space between the slits into which the flat springs are inserted.

2. A test tube holder according to claim 1, wherein each of the plurality of flat springs includes:

an elongated flat spring body curved with a curvature approximate to that of an inner surface of the holder body;

a support member formed on at least part of one side edge of the flat spring body and inserted into and supported by a corresponding one of the slits;

a bar-shaped contact section formed on another side edge of the flat spring body and contacting an outer surface of the test tube at a given pressure in a longitudinal direction thereof; and a test tube inserting guide section connected to an end portion of the contact section and having an inclined plane which is inclined gradually in a direction away from the axis of the holder body.

3. A test tube holder according to claim 2, wherein the flat spring body, the support member, the contact section and the test tube inserting guide section are formed integrally as one component by processing a single elastic member.

* * * * *